US007439829B2

(12) United States Patent
Fukunaga et al.

(10) Patent No.: US 7,439,829 B2
(45) Date of Patent: Oct. 21, 2008

(54) RF MODULE

(75) Inventors: Tatsuya Fukunaga, Tokyo (JP); Masaaki Ikeda, Tokyo (JP); Kiyoshi Hatanaka, Tokyo (JP)

(73) Assignee: TDK Corporation, Tokyo (JP)

( * ) Notice: Subject to any disclaimer, the term of this patent is extended or adjusted under 35 U.S.C. 154(b) by 249 days.

(21) Appl. No.: 10/563,217

(22) PCT Filed: Mar. 31, 2004

(86) PCT No.: PCT/JP2004/004675

§ 371 (c)(1),
(2), (4) Date: Jan. 4, 2006

(87) PCT Pub. No.: WO2005/004275

PCT Pub. Date: Jan. 13, 2005

(65) Prior Publication Data

US 2006/0152307 A1 Jul. 13, 2006

(30) Foreign Application Priority Data

Jul. 8, 2003 (JP) ..... 2003-193265

(51) Int. Cl.
*H01P 5/107* (2006.01)
*H01P 1/208* (2006.01)

(52) U.S. Cl. ..... 333/208; 333/230

(58) Field of Classification Search ..... 333/25, 333/26, 208–212, 230
See application file for complete search history.

(56) References Cited

U.S. PATENT DOCUMENTS 4,320,367 A * 3/1982 Boujet ..... 333/209
5,534,830 A * 7/1996 Ralph ..... 333/128
6,977,560 B2 * 12/2005 Itoh et al. ..... 333/26

FOREIGN PATENT DOCUMENTS

| | | |
|---|---|---|
| EP | 1 300 908 A1 | 4/2003 |
| JP | A 04-287502 | 10/1992 |
| JP | A 06-053711 | 2/1994 |
| JP | A 11-284409 | 10/1999 |
| JP | A 2000-216605 | 8/2000 |
| JP | A 2002-135003 | 5/2002 |
| JP | B2 3351351 | 9/2002 |
| JP | A 2003-110307 | 4/2003 |

* cited by examiner

*Primary Examiner*—Seungsook Ham
(74) *Attorney, Agent, or Firm*—Oliff & Berridge, PLC

(57) ABSTRACT

The present invention provides an RF module capable of converting electromagnetic waves in the TE mode to balanced electromagnetic waves in the TEM mode without adjustment and outputting the balanced electromagnetic waves while easily realizing miniaturization. The RF module includes: a waveguide (3) in which a half-wavelength TE mode resonator (2) is formed; an E plane coupling window (4) formed in a wall portion (3*a*) orthogonal to an H plane out of wall portions (3*a*) to (3*e*) constructing the TE mode resonator (2) in the waveguide (3); an output line (5*a*) provided at the edge on the side of the wall portion (3*d*) parallel with the H plane on the E plane coupling window (4), and magnetically coupled to electromagnetic waves in the TE mode resonator (2); and another output line (5*b*) provided at the edge on the side of the wall portion (3*e*) parallel with the H plane in the E plane coupling window (4), and magnetically coupled to the electromagnetic waves.

7 Claims, 10 Drawing Sheets

RF MODULE

TECHNICAL FIELD

The present invention relates to an RF module used for propagation of electromagnetic waves such as microwaves and millimeter waves.

BACKGROUND ART

In association with improvement in a mobile communication technique and the like, the frequency band of waves used for communication is being spread to a high-frequency area such as a GHz band and communication devices used for communication are also being miniaturized. RF modules such as a waveguide and a filter used in communication devices of this kind are also being requested to realize higher frequencies and further miniaturization. A waveguide line as disclosed in Japanese Patent Laid-open No. Hei 6-53711 and a filter using such a waveguide line as disclosed in Japanese Patent Laid-open No. Hei 11-284409 have been developed. As connection structures for connecting an RF module of this kind, connection structures as disclosed in Japanese Patent Laid-open Nos. 2000-216605 and 2003-110307 have been developed.

In this case, the waveguide line disclosed in Japanese Patent Laid-open No. Hei 6-53711 includes, as shown in FIG. 1 in the publication, a dielectric substrate (1) having conductor layers (2 and 3) and a plurality of conduction holes (4) which connect between the conductor layers (2 and 3) and are disposed in two lines. The waveguide line is constructed by a pseudo rectangular waveguide in which a region in the conductor is used as a line for transmitting a signal by surrounding all directions of a dielectric material with the pair of conductor layers (2 and 3) and pseudo conductive walls formed by the plurality of conduction holes (4). In this case, a waveguide line having such a configuration is also called a dielectric waveguide line.

The filter disclosed in Japanese Patent Laid-open No. Hei 11-284409 is constructed by, as shown in FIG. 1 in the publication, disposing a plurality of through conductors (26) forming an inductive window (coupling window) so as to establish electric connection (conduction) between a pair of main conductor layers (22 and 23) in a dielectric waveguide line (25) as a pseudo rectangular waveguide constructed by a dielectric substrate (21), the pair of main conductor layers (22 and 23) and a through conductor group (24) for sidewalls in a similar manner to the waveguide line disclosed in Japanese Patent Laid-open No. Hei 6-53711. Since the filter can be formed inside the dielectric substrate such as a wiring board, the filter can be easily miniaturized.

In a connection structure between a dielectric waveguide line (pseudo rectangular waveguide) and a line conductor (microstrip line) disclosed in the Japanese Patent Laid-open No. 2000-216605, as shown in FIG. 1 in the publication, an end of a line conductor (20) is inserted into an open end of a dielectric waveguide line (16), and the end and one main conductor layer (12) are electrically connected to each other via a line conductor (18) for connection and a through conductor (17) for connection so as to form steps. The connection structure is a so-called ridge waveguide structure in which the interval between the pair of main conductor layers (12 and 13) is narrowed. Therefore, at the time of propagation of RF signals (electromagnetic waves) from the line conductor (20) to the dielectric waveguide line (16), electromagnetic waves propagating in the TEM mode through the line conductor (20) are mode-converted into electromagnetic waves propagating in a TE mode ($TE_{10}$ mode) through the dielectric waveguide line (16). In other words, the connection structure changes the line conductor (microstrip line) to the waveguide line.

On the other hand, in a connection structure between the waveguide line (in this example, the waveguide line is a component of a dielectric waveguide filter) and a line conductor (microstrip line) disclosed in the Japanese Patent Laid-open No. 2003-110307, as shown in FIG. 1 in the publication, protruding portions (17*a* and 17*b*) are formed on the outside of dielectric waveguide resonators (11*a* and 11*d*) forming a dielectric waveguide filter, and conductive strip lines (15*a* and 15*b*) extending from the bottom surfaces of the dielectric waveguide resonators (11*a* and 11*b*) to the protruding portions (17*a* and 17*b*) and serving as input and output electrodes are formed. The conductive strip lines (15*a* and 15*b*) are connected to conductive patterns (19*a* and 19*b*) as line conductors formed on a wiring board (18). In the connection structure, the conductive patterns (19*a* and 19*b*) are terminated on the bottom surfaces of the dielectric waveguide resonators (11*a* and 11*d*) via the conductive strip lines (15*a* and 15*b*) formed so as to have the same width as that of the conductor patterns (19*a* and 19*b*). Thus, to the bottom surfaces of the dielectric waveguide resonators (11*a* and 11*d*), input and output signals in the TEM mode are supplied via the conductive patterns (19*a* and 19*b*), respectively. Therefore, magnetic fields generated in the dielectric waveguide resonators (11*a* and 11*d*) by the input and output signals are coupled to magnetic fields in a fundamental resonance mode (TE mode ($TE_{10}$ mode)) of the dielectric waveguide resonators (11*a* and 11*d*). As a result, electromagnetic waves propagating in the TEM mode in the conductive patterns (19*a* and 19*b*) are mode-converted into electromagnetic waves propagating in the TE mode ($TE_{10}$ mode) in the dielectric waveguide resonators (11*a* and 11*d*) as dielectric waveguide lines. Electromagnetic waves propagating in the TE mode ($TE_{10}$ mode) in the dielectric waveguide resonators (11*a* and 11*d*) are mode-converted into electromagnetic waves propagating in the TEM mode in the conductive patterns (19*a* and 19*b*). That is, the connection structure has the line converting function of converting a line conductor (microstrip line) to a waveguide line or converting a waveguide line to a line conductor.

Incidentally, for example, as disclosed in the Japanese Patent Laid-open Nos. 2000-216605 and 2003-110307, although most of RF modules currently proposed are to output electromagnetic waves in the TEM mode from the dielectric waveguide line (waveguide) as unbalanced electromagnetic waves, there is also a demand for realizing an RF module (mode converter or line converter) which outputs balanced RF signals in the TEM mode from a waveguide through which electromagnetic waves in the TE mode propagate. To address the demand, for example, an RF module (dielectric filter) as disclosed in Japanese Patent Publication No. 3351351 has been proposed. In the dielectric filter, as shown in FIG. 1 in the publication, on an outer surface of a dielectric block (1), an external terminal (8) continued from one end of an external coupling line (25) and an external terminal (6) generating capacitance in cooperation with a resonance line (5*a*) are formed, thereby constructing an unbalanced to balanced conversion circuit. The phase difference between one of output signals output from the external terminal (6) by the capacitive coupling and the other output signal output from the external terminal (8) by the inductive coupling is set to 180 degrees by adjusting a capacitance value and an inductance value of the coupled portions.

However, the unbalanced to balanced conversion circuit disclosed in the Japanese Patent Publication No. 3351351 has the following problems. In the unbalanced to balanced conversion circuit, in order to set the phase difference between the two output signals to 180 degrees, the capacitance value of the capacitive coupling and the inductance value of the inductive coupling have to be adjusted. Therefore, the unbalanced to balanced conversion circuit has the problems such that it requires some time and effort for the adjustment work and it is difficult to miniaturize the circuit since a signal path which is not operated as a resonator has to be provided in addition to a resonator.

DISCLOSURE OF INVENTION

The present invention has been achieved in consideration of such problems, and a main object of the invention is to provide an RF module capable of converting electromagnetic waves in the TE mode to balanced electromagnetic waves in the TEM mode and outputting the resultant electromagnetic waves without adjustment while easily realizing miniaturization.

An RF module according to a first aspect of the present invention to achieve the object includes: a waveguide in which a half-wavelength TE mode resonator is formed; at least one E plane coupling window formed in a wall portion orthogonal to an H plane out of wall portions constructing the TE mode resonator in the waveguide; one output line provided at the edge on the side of one of the wall portions parallel with the H plane in the one E plane coupling window, and magnetically coupled to electromagnetic waves in the TE mode resonator; and another output line provided at the edge on the side of the other wall portion parallel with the H plane in the one E plane coupling window or another E plane coupling window, and magnetically coupled to the electromagnetic waves.

The E plane coupling window is a coupling window for magnetically coupling the output line to the electromagnetic waves in the TE mode propagating through the waveguide in the E plane. The wall portion orthogonal to the H plane denotes a wall portion parallel with the E plane.

The RF module according to the first aspect of the present invention may be constructed in such a manner that only one E plane coupling window is provided as the E plane coupling window, the one output line is provided at the edge on the side of the one wall portion parallel with the H plane in the one E plane coupling window, and magnetically coupled to electromagnetic waves in the TE mode resonator; and the another output line is provided at the edge on the side of the other wall portion parallel with the H plane in the one E plane coupling window, and magnetically coupled to the electromagnetic waves.

The RF module according to the first aspect of the present invention may be constructed in such a manner that two E plane coupling windows formed in a single wall portion orthogonal to an H plane out of wall portions constructing the TE mode resonator are provided as the E plane coupling window, the one output line provided at the edge on the side of one of the wall portions parallel with the H plane in one of the two E plane coupling windows, and magnetically coupled to electromagnetic waves in the TE mode resonator; and the another output line is provided at the edge on the side of the other wall portion parallel with the H plane in the other E plane coupling window out of the two coupling windows and magnetically coupled to the electromagnetic waves.

The RF module according to the first aspect of the invention may be also constructed in such a manner that a pair of E plane coupling windows formed in a pair of wall portions which are orthogonal to an H plane out of wall portions constructing the TE mode resonator and which are different from each other are provided as the E plane coupling window, the one output line is provided at the edge on the side of the one wall portion parallel with the H plane in one of the pair of E plane coupling windows, and magnetically coupled to electromagnetic waves in the TE mode resonator, and the another output line is provided at the edge on the side of the other wall portion in parallel with the H plane in the other E plane coupling window out of the pair of E plane coupling windows, and magnetically coupled to the electromagnetic waves.

An RF module according to a second aspect of the invention includes: a waveguide in which a half-wavelength TE mode resonator is formed; at least one H plane coupling window formed in a wall portion parallel with an H plane out of wall portions constructing the TE mode resonator in the waveguide; one output line provided at either the edge on the center side or the edge on the outer periphery side of the TE mode resonator in the one H plane coupling window, and magnetically coupled to electromagnetic waves in the TE mode resonator; and another output line provided at either the edge on the center side or the edge on the outer periphery side of the TE mode resonator at the edge of either the one H plane coupling window or another H plane coupling window and magnetically coupled to the electromagnetic waves.

The H plane coupling window is a coupling window for magnetically coupling the output line to the electromagnetic waves in the TE mode propagating through the waveguide in the H plane.

The RF module according to the second aspect of the invention may be constructed in such a manner that only one H plane coupling window is provided as the H plane coupling window, the one output line is provided at the edge on the center side of the TE mode resonator in the one H plane coupling window and magnetically coupled to electromagnetic waves in the TE mode resonator, and the another output line is provided at the edge on the outer periphery side of the TE mode resonator at the edge of the one H plane coupling window and magnetically coupled to the electromagnetic waves.

The RF module according to the second aspect of the invention may be constructed in such a manner that two H plane coupling windows formed in one wall portion parallel with an H plane out of wall portions constructing the TE mode resonator are provided as the H plane coupling window, the one output line is provided at the edge on the center side of the TE mode resonator in one of the two H plane coupling windows and magnetically coupled to electromagnetic waves in the TE mode resonator, and the another output line is provided at the edge on the side of the outer periphery of the TE mode resonator at the edge of the other of the two H plane coupling windows, and magnetically coupled to the electromagnetic waves.

The RF module according to the second aspect of the invention may be constructed in such a manner that two H plane coupling windows formed in two wall portions parallel with an H plane in wall portions constructing the TE mode resonator are provided as the H plane coupling window, the one output line is provided at either the edge on the center side or the edge on the side of the outer periphery of the TE mode resonator in one of the two H plane coupling windows, and magnetically coupled to electromagnetic waves in the TE mode resonator, and the another output line is provided at the edge in the other of the two H plane coupling windows, which is the edge on the same side as the edge at which the one output line is provided in one of the H plane coupling windows, and magnetically coupled to the electromagnetic waves.

An RF module according to a third aspect of the invention includes: a waveguide in which a half-wavelength TE mode resonator is formed; an E plane coupling window formed in a wall portion orthogonal to an H plane out of wall portions constructing the TE mode resonator in the waveguide; an H plane coupling window formed in one of wall portions parallel with the H plane in the wall portions; one output line provided at the edge on the side of the wall portion in which the H plane coupling window is formed in the E plane coupling window, and magnetically coupled to electromagnetic waves in the TE mode resonator; and another output line provided at the edge on the side of the outer periphery of the TE mode resonator in the H plane coupling window, and magnetically coupled the electromagnetic waves.

An RF module according to a fourth aspect of the invention includes: a waveguide in which a half-wavelength TE mode resonator is formed; an E plane coupling window formed in a wall portion orthogonal to an H plane out of wall portions constructing the TE mode resonator in the waveguide; an H plane coupling window formed in one of wall portions parallel with the H plane of the wall portions; one output line provided at the edge on the side of a wall portion facing the wall portion in which the H plane coupling window is formed in the E plane coupling window, and magnetically coupled to electromagnetic waves in the TE mode resonator; and another output line provided at the edge on the center side of the TE mode resonator in the H plane coupling window, and magnetically coupled to the electromagnetic waves.

In each of the RF modules according to the first to fourth aspect of the invention, preferably, the waveguide is constructed so as to include a pair of ground electrodes provided so as to face each other and a conductor for making the pair of ground electrodes conductive. Preferably, each of the RF modules includes an input line capable of supplying electromagnetic waves in the TEM mode as electromagnetic waves in the TE mode to the waveguide. In this case, each of the RF modules may include at least one resonator between the input line and the half-wavelength TE mode resonator.

BEST MODE FOR CARRYING OUT THE INVENTION

Preferable embodiments of RF modules according to the present invention will be described hereinbelow with reference to the attached drawings.

First Embodiment

First, the configuration of the RF module according to the embodiment will be described with reference to the drawings.

Figure 1:
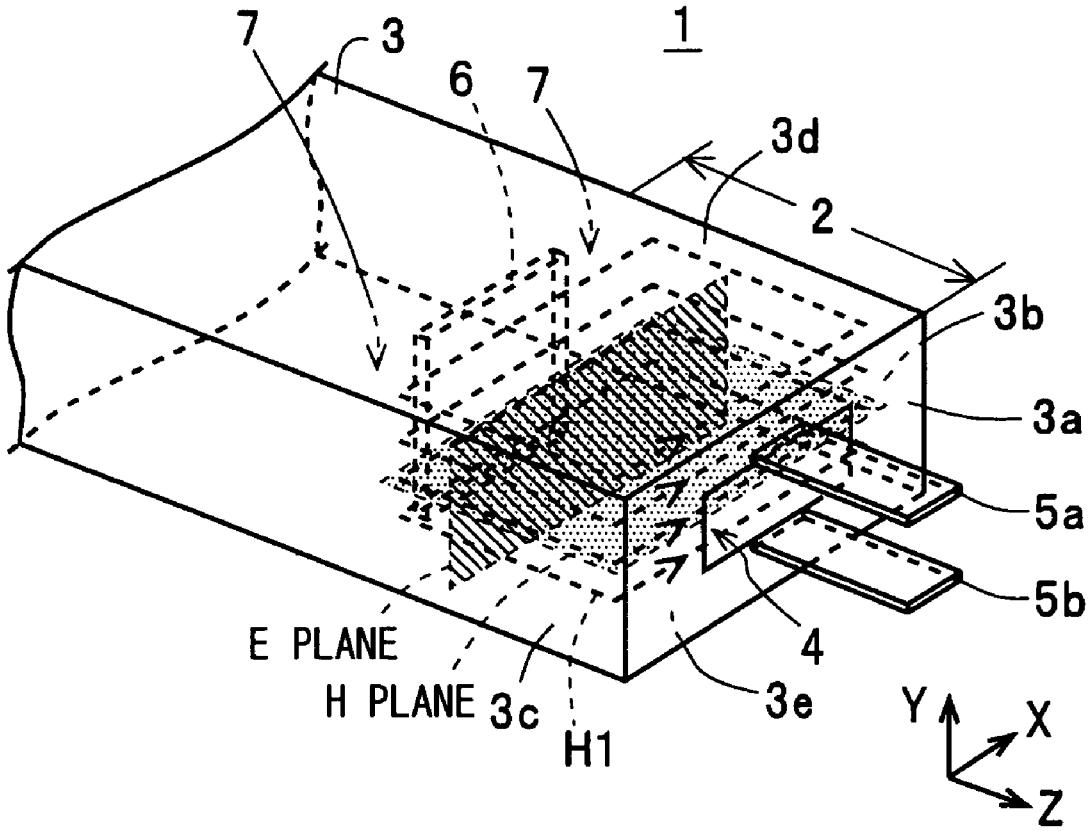
FIG. 1 is a perspective view showing the configuration of an RF module 1 according to a first embodiment of the invention.

An RF module 1 functioning as a filter (concretely, a bandpass filter), as shown in FIG. 1, includes: a rectangular waveguide (a waveguide whose sectional shape along a direction orthogonal to a travel direction of an electromagnetic wave is rectangular) 3 in which a half-wavelength TE-mode resonator 2 resonating at a wavelength which is the half of a wavelength in a waveguide of an electromagnetic wave in the TE mode (concretely, $TE_{10}$ mode of the lowest order) is formed; an E plane coupling window 4 formed in a wall portion 3*a* (parallel with the E plane) orthogonal to an H plane (plane parallel with the XZ plane) in wall portions 3*a*, 3*b*, 3*c*, 3*d*, and 3*e* forming the TE mode resonator 2 in the waveguide 3; and a pair of output lines 5*a* and 5*b* whose one end portions are connected (short-circuit connected) to the wall portion 3*a* so as to sandwich the E plane coupling window 4 and magnetically coupled to the electromagnetic waves in the TE mode on the E planes (hereinbelow, also called "E plane coupling"), and through which electromagnetic waves in the TEM mode propagate. In this case, as an example, TE mode resonator 2 is formed between a partition wall 6 disposed inside the waveguide 3 and the wall portion 3*a* as a short-circuit face of the waveguide 3. The TE mode resonator 2 is magnetically coupled to another inner region of the waveguide 3 (in the diagram, a region on the left side of the TE mode resonator 2) via coupling windows 7 formed by spaces between two side walls (side walls including the wall portions 3*b* and 3*c*) of the waveguide 3 and the partition wall 6. The E plane coupling window 4 is formed, as an example, in a rectangular shape in plan view and is formed in a center portion of the wall portion 3*a* so that its four sides are parallel with corresponding sides of the wall portion 3*a*. The pair of output lines 5*a* and 5*b* are formed in plane lines (such as microstrip lines, coplanar lines, and strip lines) and provided on the wall 3*a* while sandwiching the E plane coupling window 4. Concretely, the output line 5*a* is provided (short-circuit connected) at the edge of the E plane coupling window 4, specifically, the edge on the side of the wall portion 3*d* as one of the wall portions parallel with the H plane (the edge on the upper side in FIG. 1), and the output line 5*b* is provided (short-circuit connected) at the edge of the E plane coupling window 4, specifically, the edge on the side of the other wall portion 3*e* parallel with the H plane (the edge on the lower side in FIG. 1). In this case, the output lines 5*a* and 5*b* are provided so that positions along the width direction (X direction) of the H plane are the same at the edge of the E plane coupling window 4. In the embodiment, as an example, the pair of output lines 5*a* and 5*b* are connected so that their positions along the X direction in the H plane are in the center portion of the wall portion 3*a*.

Next, the operation of the RF module 1 will be described.

Figure 2:
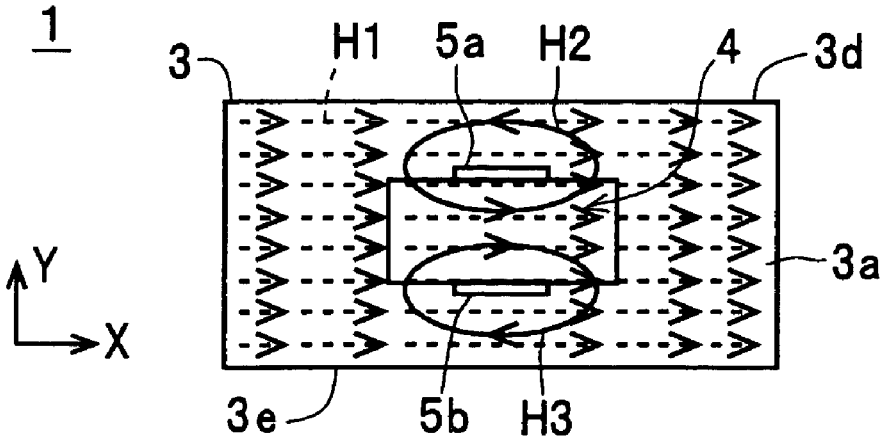
FIG. 2 is an explanatory drawing showing the magnetic field distribution of a magnetic field H1 in/around connection parts to a waveguide 3 in output lines 5*a* and 5*b* of the RF module 1 and the states of magnetic fields H2 and H3 generated in the output lines 5*a* and 5*b*, respectively.
Figure 3:
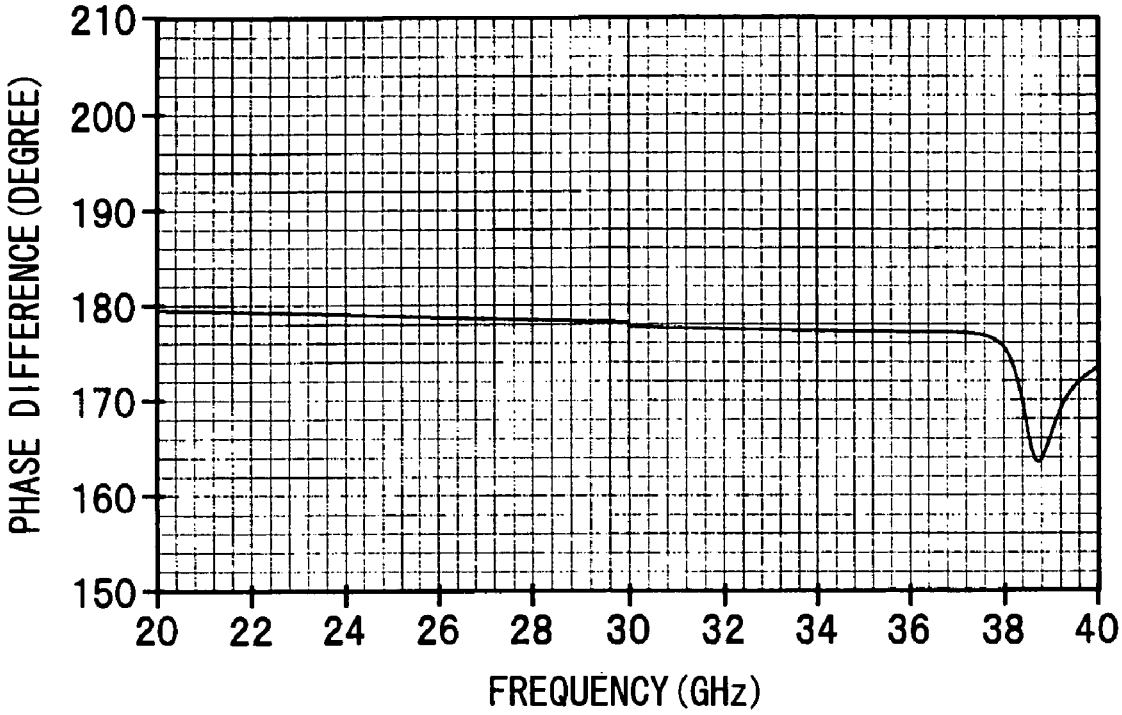
FIG. 3 is a characteristic diagram showing the relation between the frequency and the phase difference in the RF module 1.

In the RF module 1, a magnetic field H1 parallel with the H plane is generated in the frequency band in which the TE mode resonator 2 acts as a resonator for electromagnetic waves (signal passband of the RF module 1) as shown in FIG. 1. Therefore, in a region near the wall portion 3*a* in the TE mode resonator 2, as schematically shown in FIG. 2, the directions of the magnetic fields H1 are aligned in one direction (X direction). Consequently, a magnetic field H2 in the TEM mode in the direction shown in the diagram (the counter clockwise direction) is generated in the output line 5*a*, and a magnetic field H3 in the TEM mode in the direction shown in the diagram (the clockwise direction) is generated in the output line 5*b*. That is, the directions of the magnetic fields H2 and H3 generated in the output lines 5*a* and 5*b* are always opposite to each other in the signal passband. The phases of electromagnetic waves in the TEM mode output from the TE mode resonator 2 to the output lines 5*a* and 5*b* are shifted from each other by almost 180 degrees in the signal passband. According to a result of a simulation, in the RF module 1, as shown in FIG. 3, the phase difference between the electromagnetic waves output from the output lines 5*a* and 5*b* is almost constant in a range from 177 degrees to 180 degrees in a wider frequency band (band from about 20 $GH_z$ to about 37 $GH_z$) including the signal passband (band from about 25 $GH_z$ to about 25.4 $GH_z$). Therefore, from the pair of output lines 5*a* and 5*b*, the electromagnetic waves in the TEM mode converted to a balanced type are output. That is, the RF module 1 functions as a filter and also as a mode converter for converting the TE mode to the TEM mode. The RF module 1 also functions as a line converter for converting the waveguide 3 to a plane line.

Figure 4:
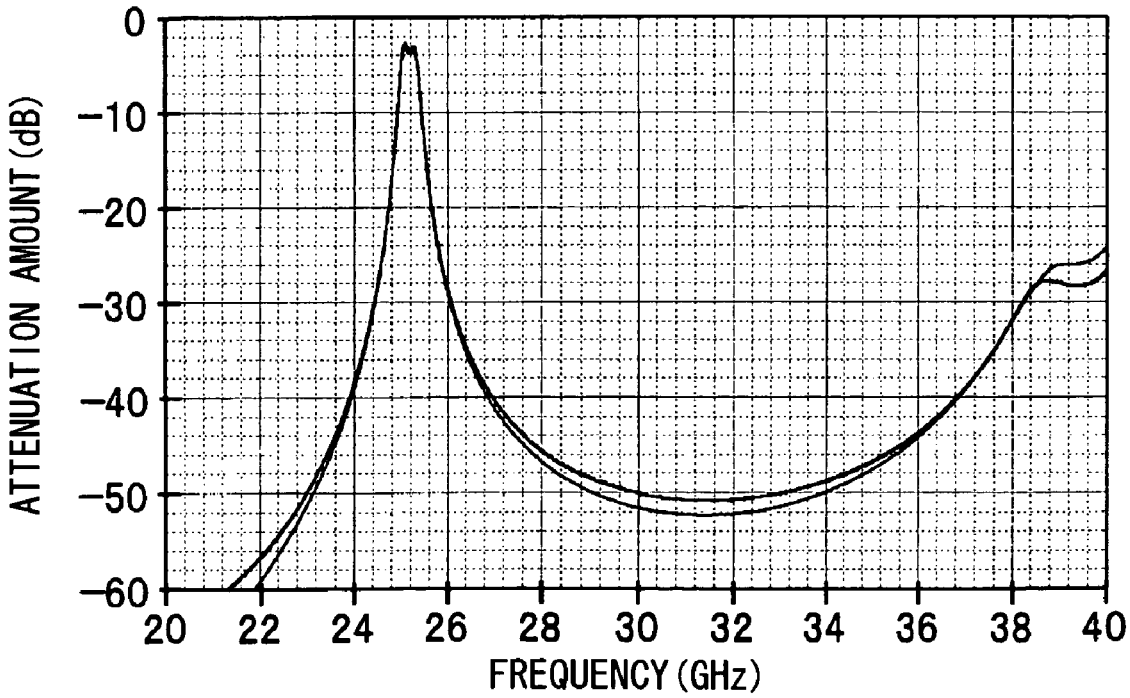
FIG. 4 is a characteristic diagram showing the relation between the frequency and the attenuation rate in the RF module 1.

On the other hand, the intensity distribution of the magnetic field H1 along the direction (X direction) parallel with the H plane in the E plane in a region around the wall portion 3*a* of the TE mode resonator 2, as shown in FIG. 2, is highest in a center portion of the TE mode resonator 2 (a center portion of the wall portion 3*a*) and becomes lower toward the ends (in FIG. 2, the intensities of the magnetic fields H1 are indicated by lengths of arrows). The intensity distributions of the magnetic fields H1 along the direction (Y direction) orthogonal to the H plane in the E plane in the region around the wall portion 3*a* are almost uniform as shown in FIG. 2. Therefore, the magnetic fields H2 and H3 in the output lines 5*a* and 5*b* connected to the wall portion 3*a* so that their positions along the X direction in the H plane are the same have almost the same intensity in the signal passband in which the TE mode resonator 2 acts as a resonator at the electromagnetic waves. As a result, intensities of the electromagnetic waves in the TEM mode output from the output lines 5*a* and 5*b* almost coincide with each other. Therefore, balanced electromagnetic waves in the TEM mode having balanced magnitude (the same magnetic field intensity) are output from the output lines 5*a* and 5*b*. According to the result of the simulation, in the RF module 1, as shown in FIG. 4, the intensities (attenuation amounts) of the electromagnetic waves output from the pair of output lines 5*a* and 5*b* almost coincide with each other in the signal passband. The magnitude balance in the balanced electromagnetic waves in the TEM mode output from the pair of output lines 5*a* and 5*b* can be adjusted by changing the positions of connection to the wall portion 3*a* of the output lines 5*a* and 5*b* along the X direction.

As described above, in the RF module 1, the E plane coupling window 4 is formed in the wall portion 3*a* orthogonal to the H plane (parallel with the E plane) in the wall portions forming the TE mode resonator 2 in the waveguide 3, and the output lines 5*a* and 5*b* which are E-plane coupled at the electromagnetic waves in the TE mode resonator 2 are provided at the edge on the side of the wall portion 3*d* parallel with the H plane and the edge on the side of the wall portion 3*e* parallel with the H plane, respectively, in the wall portion 3*a* while sandwiching the E plane coupling window 4. Consequently, in the signal passband, the phase difference between the electromagnetic waves output from the output lines 5*a* and 5*b* can be set to be almost 180 degrees without adjustment. Therefore, while realizing a simple and small-sized configuration, the RF module 1 can convert electromagnetic waves in the TE mode propagating through the waveguide 3 into balanced electromagnetic waves in the TEM mode without adjustment and output the balanced electromagnetic waves. That is, a line converter capable of converting a line from the waveguide 3 to a plane line (balanced plane line) without requiring phase adjustment can be realized.

Figure 5:
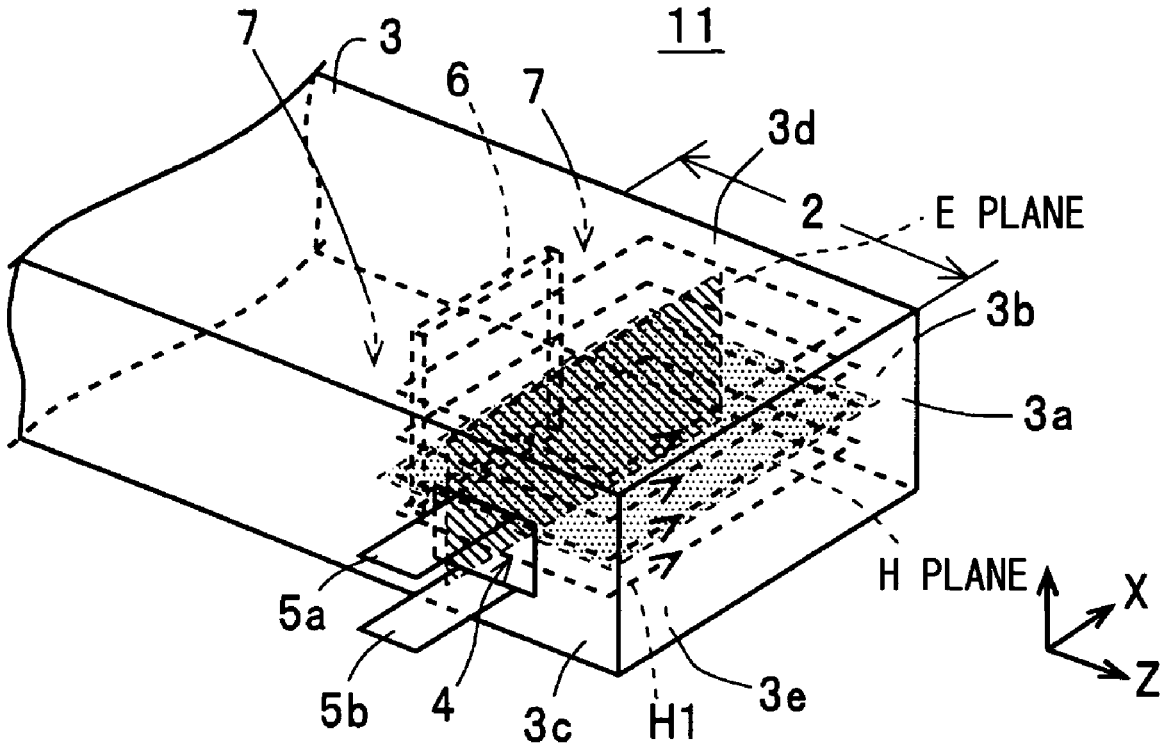
FIG. 5 is a perspective view showing the configuration of an RF module 11 according to the first embodiment of the invention.

In the above description, the RF module 1 has a configuration, as an example, in which one E plane coupling window 4 is formed in the wall portion 3*a* orthogonal to the H plane and the pair of output lines 5*a* and 5*b* are provided (short-circuit connected) on the wall portion 3*a* so as to sandwich the E plane coupling window 4. Alternately, as shown in FIG. 5, an RF module 11 can be also constructed by providing the E plane coupling window 4 and the pair of output lines 5*a* and 5*b* for another wall portion 3*b* or 3*c* orthogonal to the H plane (in FIG. 5, the wall portion 3*c* as an example). Since the configuration of the RF module 11 is similar to that of the RF module 1 except that the E plane coupling window 4 and the pair of output lines 5*a* and 5*b* are provided for the wall portion 3*c*, the same reference numerals are designated to the same components and the description will not be repeated. In FIG. 5, for simplicity of the diagram, the thickness of the output lines 5*a* and 5*b* is not described. Also in the following FIGS. 7, 10, 14, 15, and 16, the thickness of the output lines 5*a* and 5*b* is not similarly described.

Figure 6:
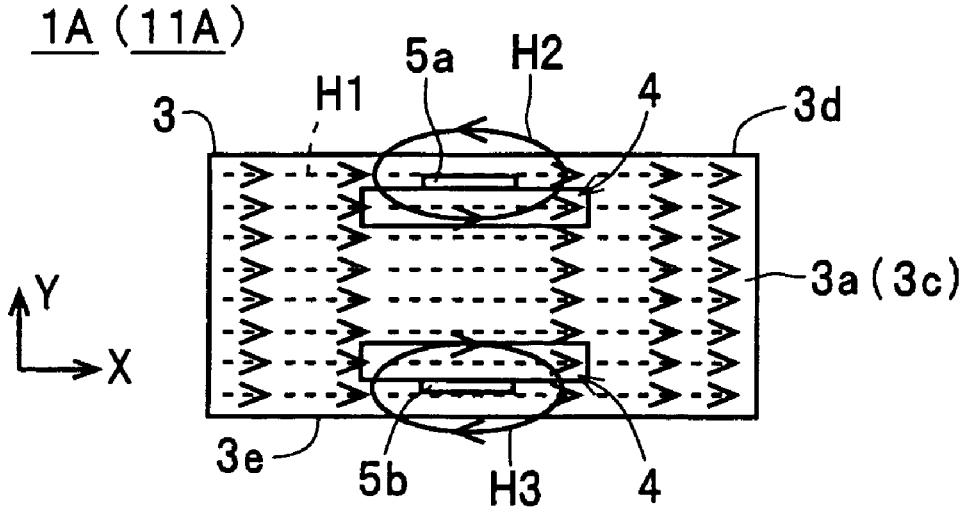
FIG. 6 is an explanatory drawing showing the magnetic field distribution of the magnetic field H1 in/around connection parts to the waveguide 3 in the output lines 5*a* and 5*b* of an RF module 1A (11A) in which two E plane coupling windows 4 are provided in a wall portion 3*a*, and showing the states of the magnetic fields H2 and H3 generated in the output lines 5*a* and 5*b*, respectively.

The RF module 1 (or 11) has been described with respect to the example in which one E plane coupling window 4 is formed in one wall portion 3*a* (wall portion 3*c*) and the pair of output lines 5*a* and 5*c* are provided for (short-circuit connected to) the wall portion 3*a* (wall portion 3*c*) so as to sandwich the E plane coupling window 4. Alternately, as shown in FIG. 6, an RF module 1A (or 11A) can be constructed by forming a plurality of (two, as an example) E plane coupling windows 4 in the wall portion 3*a* (or wall portion 3*c*), providing (short-circuit connecting) the output line 5*a* for the edge of one of the E plane coupling windows 4, and providing (short-circuit connecting) the output line 5*b* for the edge of the other E plane coupling window 4. Concretely, for example, the output line 5*a* is provided for the edge of one of the E plane coupling windows 4 (the E plane coupling window 4 on the upper side in the diagram), which is the edge on the side of one wall portion 3*d* parallel with the H plane (the edge on the upper side in the diagram). The other output line 5*b* is provided for the edge of the other E plane coupling window 4 (the E plane coupling window 4 on the lower side in the diagram), which is the edge on the side of the other wall portion 3*e* parallel with the H plane (the edge on the lower side in the diagram). It is also possible that the output line 5*a* is disposed for the edge of one E plane coupling window 4 (the E plane coupling window 4 on the upper side in the diagram), which is the edge on the side of the wall portion 3*e* parallel with the H plane (the edge on the lower side in the diagram), and the output line 5*b* is provided for the edge of the other E plane coupling window 4 (the E plane coupling window 4 on the lower side in the diagram), which is the edge on the side of the other wall portion 3*d* parallel with the H plane (the edge on the upper side in the diagram).

In also this configuration, the directions of the magnetic fields H2 and H3 in the pair of output lines 5*a* and 5*b* are always opposite to each other in the signal passband as shown in FIG. 6. Therefore, the phase difference between the electromagnetic waves output from the output lines 5*a* and 5*b* can be set to be almost 180 degrees without adjustment. As a result, electromagnetic waves in the TE mode can be converted into the balanced electromagnetic waves in the TEM mode without adjustment and the balanced electromagnetic waves in the TEM mode can be output. Further, with the configuration, two E plane coupling windows 4 can be formed in arbitrary positions in the wall portion 3*a* (or 3*c*). Accordingly, the pair of output lines 5*a* and 5*b* can be provided in arbitrary positions in the wall portion 3*a* (or 3*c*). Therefore, the balanced electromagnetic waves in the TEM mode can be output from arbitrary positions in the wall portion 3*a* (or 3*c*).

Second Embodiment

Figure 7:
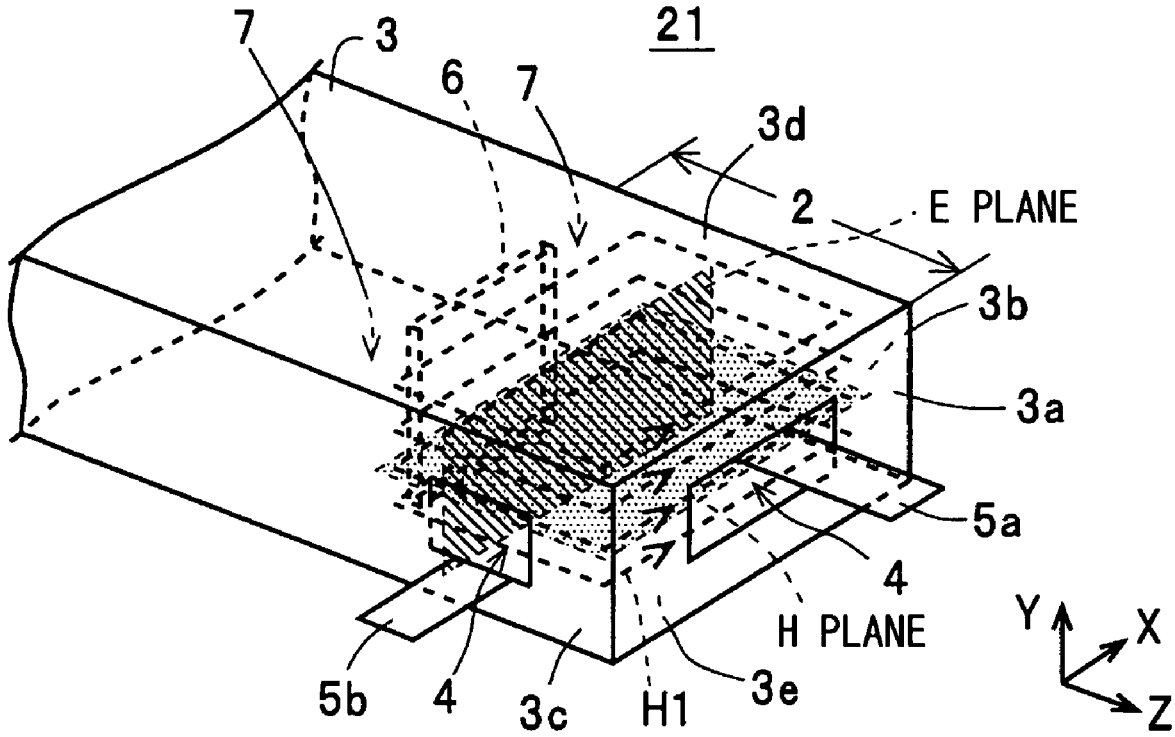
FIG. 7 is a perspective view showing the configuration of an RF module 21 according to a second embodiment of the invention.

The RF modules 1, 1A, 11, and 11A described above employ the configuration in which the E plane coupling window 4 is formed in a wall portion (the same wall portion) as one of the wall portions forming the TE mode resonator 2 in the waveguide 3. An RF module 21 in which the E plane coupling windows 4 are formed in a pair of wall portions different from each other will now be described. As shown in FIG. 7, the RF module 21 is constructed so that one of the E plane coupling windows 4 is formed in the wall portion 3*a* as one of wall portions orthogonal to the H plane, and the other E plane coupling window 4 is formed in one (for example, the wall portion 3*c*) of the other wall portions 3*b* and 3*c* orthogonal to the H plane. The output line 5*a* is provided for (short-circuit connected to) the edge on the side of one wall portion (the wall portion 3*d*) parallel with the H plane in the E plane coupling window 4. The other output line 5*b* is provided for (short-circuit connected to) the edge on the side of the other wall portion (the wall portion 3*e*) parallel with the H plane in the other E plane coupling window 4. It is also possible to employ the configuration in which one of the E plane coupling windows 4 is formed in the wall portion 3*b*, and the other E plane coupling window 4 is formed in the wall portion 3*c*.

Figure 8:
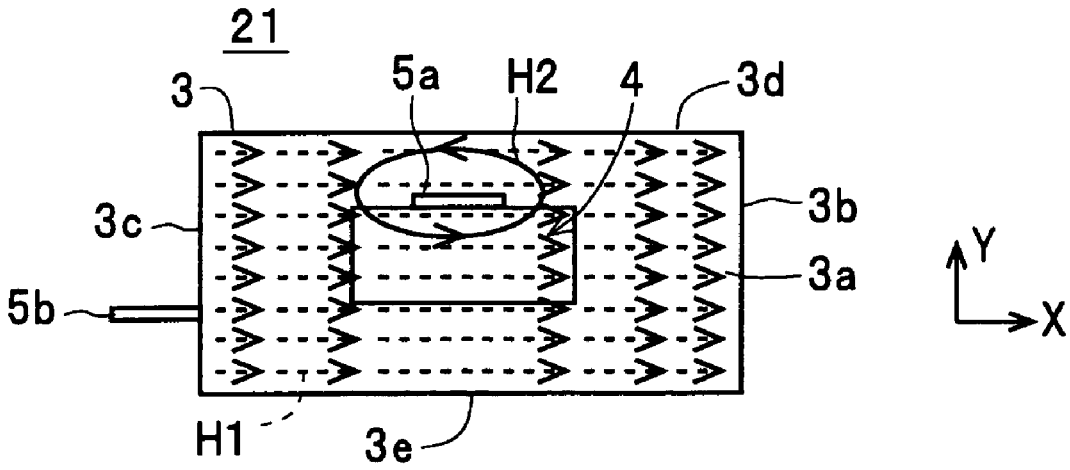
FIG. 8 is an explanatory drawing showing the magnetic field distribution of the magnetic field H1 in/around a connection part to the waveguide 3 in the output line 5*a* of the RF module 21 and the state of the magnetic field H2 generated in the output line 5*a*.
Figure 9:
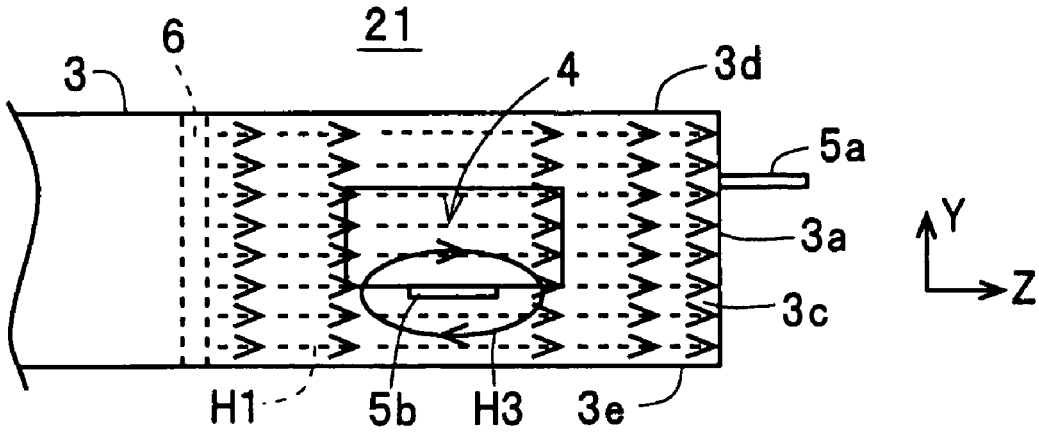
FIG. 9 is an explanatory drawing showing the magnetic field distribution of the magnetic field H1 in/around a connection part to the waveguide 3 in the output line 5*b* of the RF module 21 and the state of the magnetic field H3 generated in the output line 5*b*.

Also in the RF module 21, as shown in FIGS. 8 and 9, directions of the magnetic fields H2 and H3 in the output lines 5*a* and 5*b* provided for (short-circuit connected to) the wall portions 3*a* and 3*c*, respectively, are always opposite to each other in the signal passband in a similar manner to the RF module 1. Therefore, in also the RF module 21, the electromagnetic waves in the TEM mode converted to balanced electromagnetic waves can be output from the pair of output lines 5*a* and 5*b*. Further, in the RF module 21, by connecting the pair of output lines 5*a* and 5*b* to different wall portions, electromagnetic waves in the TEM mode converted to balanced electromagnetic waves can be easily output in directions different from each other.

Third Embodiment

Although the example of outputting electromagnetic waves in the TEM mode converted to balanced electromagnetic waves from the waveguide 3 by using the magnetic field coupling in the E plane (E plane coupling) in the RF modules 1, 1A, 11, 11A, and 21 has been described, a configuration in which electromagnetic waves in the TEM mode converted to balanced electromagnetic waves are output from the TE mode resonator 2 in the waveguide 3 by using magnetic field coupling in the H plane (hereinbelow, also called "H plane coupling") can be also employed. Since basic configurations of the waveguide 3 and the TE mode resonator 2 are the same as those in the RF module 1 and the like, the same reference numerals are designated to the same configurations and the description will not be repeated.

Figure 10:
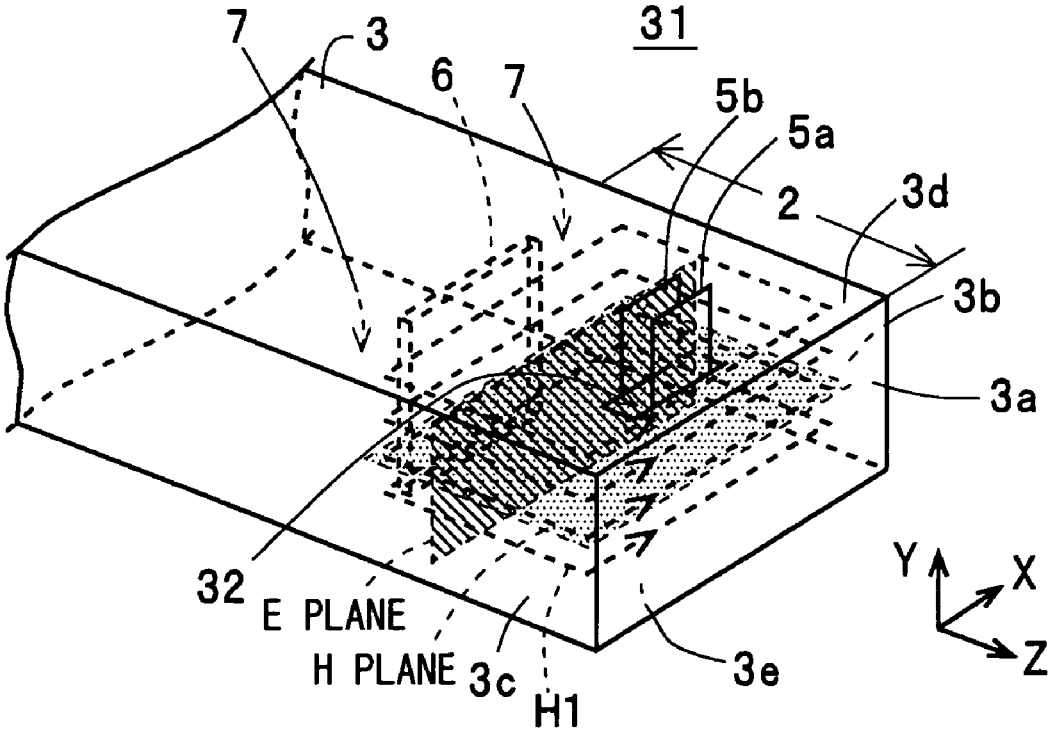
FIG. 10 is a perspective view showing the configuration of an RF module 31 according to a third embodiment of the invention.
Figure 11:
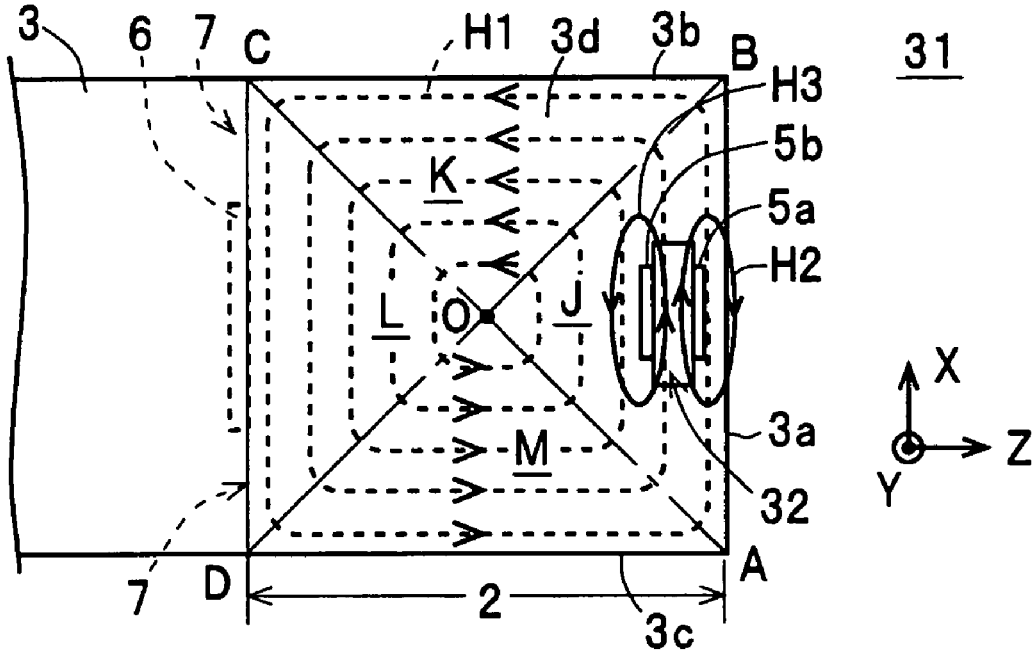
FIG. 11 is an explanatory drawing showing the magnetic field distribution of the magnetic field H1 in/around connection parts to the waveguide 3 in output lines 5*a* and 5*b* of the RF module 31 in which two H plane coupling windows 32 are provided in a wall portion 3*d* and showing the states of the magnetic fields H2 and H3 generated in the output lines 5*a* and 5*b*, respectively.

In an RF module 31 according to a third embodiment, as shown in FIG. 10, an H plane coupling window 32 is formed in the wall portion 3*d* or 3*e* (3*d* as an example in the diagram) parallel with the H plane among the wall portions 3*a*, 3*b*, 3*c*, 3*d*, and 3*e* forming the TE mode resonator 2 in the waveguide 3. The pair of output lines 5*a* and 5*b* are provided for (short-circuit connected to) the wall portion 3*d* so as to sandwich the H plane coupling window 32. As an example, as shown in FIG. 11, the H plane coupling window 32 is formed so that the outer shape is rectangle, and is formed along and near the edge on the side of the wall portion 3*a* in the wall portion 3*d*. As shown in the diagram, the pair of output lines 5*a* and 5*b* are provided at the outer-side edge and the center-side edge, respectively, of the TE mode resonator 2 in the H plane coupling window 32.

Figure 12:
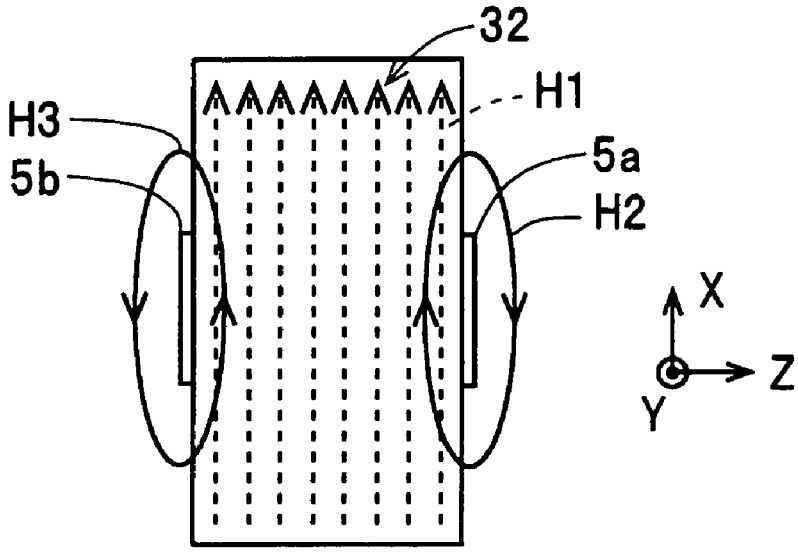
FIG. 12 is an enlarged view of an area of the H plane coupling window 32 in FIG. 11.

Also in the RF module 31, the magnetic fields H1 are generated as shown in FIG. 11 in the TE mode resonator 2 in a similar manner to those in the RF module 1. Consequently, when the center of the TE mode resonator 2 is set as O as shown in FIG. 11, directions of the magnetic fields H1 are aligned in one direction (the X direction in FIG. 11) as schematically shown in FIG. 12, in regions around the H plane coupling window 32 formed in parallel with the wall portion 3*a* (in parallel with the XY plane) inside a region J sandwiched by two line segments connecting corners A and B on the side of the wall portion 3*a* out of four corners A, B, C, and D of the TE mode resonator 2 and the center O of the TE mode resonator 2. Therefore, as shown in FIGS. 11 and 12, directions of the magnetic fields H2 and H3 in the output lines 5*a* and 5*b* provided at the edges parallel with the wall portion 3*a* in the H plane coupling window 32 while sandwiching the H plane coupling window 32 are always opposite to each other in the signal passband. Therefore, the electromagnetic waves in the TEM mode converted to balanced electromagnetic waves can be output from the pair of output lines 5*a* and 5*b*. Although not shown in the diagram, another configuration in which the H plane coupling window 32 is formed in parallel with the wall portion 3*a* inside a region L sandwiched by two line segments connecting the corners C and D of the partition wall 6 side and the center O, and the pair of output lines 5*a* and 5*b* are provided so as to sandwich the H plane coupling window 32 can be also employed. Further, although not shown in the diagram, it is also possible to employ a configuration in which the H plane coupling window 32 is formed in parallel with the wall portion 3*b* (in parallel with the YZ plane) inside a region K sandwiched by two line segments connecting the corners B and C on the side of the wall portion 3*b* out of the four corners A, B, C, and D of the TE mode resonator 2 and the center O (or a region M sandwiched by two line segments connecting the corners A and D on the side of the wall portion 3*c* and the center O), and the output lines 5*a* and 5*b* are provided at the edges parallel with the wall portion 3*b* in the H plane coupling window 32 so as to sandwich the H plane coupling window 32. Also in this configuration, similarly, the electromagnetic waves in the TEM mode converted to balanced electromagnetic waves can be output.

Figure 13:
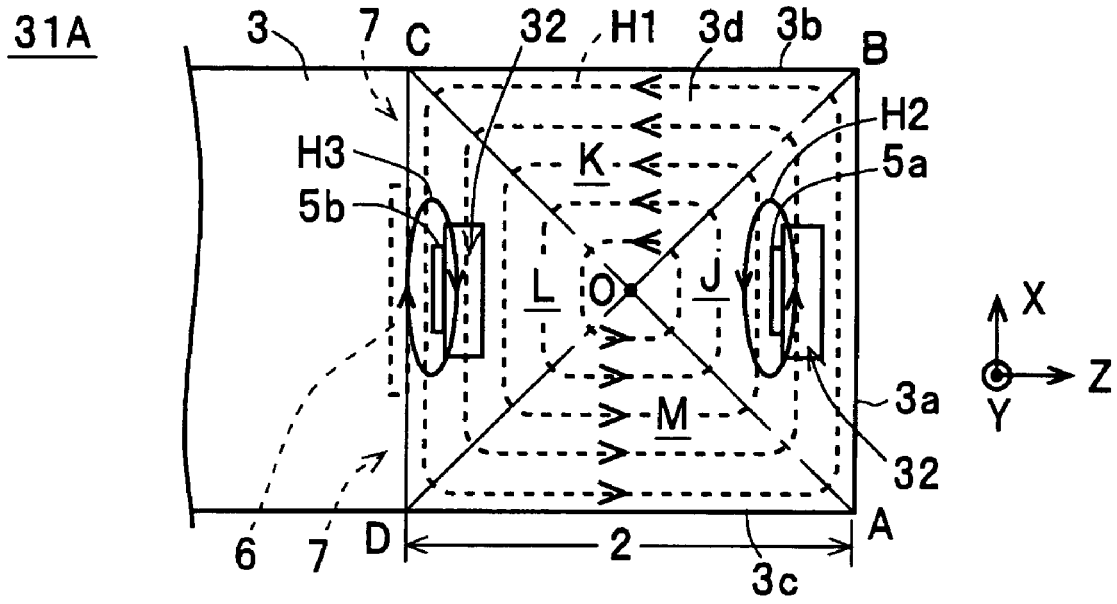
FIG. 13 is an explanatory drawing showing the magnetic field distribution of the magnetic field H1 in/around connection parts to the waveguide 3 in the output lines 5*a* and 5*b* of the RF module 31A in which the two H plane coupling windows 32 are provided in the wall portion 3*d* and showing the states of the magnetic fields H2 and H3 generated in the output lines 5*a* and 5*b*, respectively.

The RF module 31 has been described with respect to the example in which one H plane coupling window 32 is formed in the wall portion 3*d* and the pair of output lines 5*a* and 5*b* are provided at the edges of the H plane coupling window 32 so as to sandwich the H plane coupling window 32. As shown in FIG. 13, an RF module 31A can be also constructed in such a manner that a plurality (two as an example) of H plane coupling windows 32 are formed in the regions J and L in the wall portion 3*d* (or 3*e*), the output line 5*a* is provided for (short-circuit connected to) one of the H plane coupling windows 32, and the output line 5*b* is provided for (short-circuit connected to) the other H plane coupling window 32. Concretely, one output line 5*a* is provided at the edge (the edge on the center side in the TE mode resonator 2) of one of the H plane coupling windows 32 (the H plane coupling window 32 on the side of the region J in the diagram). On the other hand, the other output line 5*b* is provided at the edge of the other H plane coupling window 32 (the H plane coupling window on the side of the region L in the diagram), which is the edge on the outer periphery side of the TE mode resonator 2. Also in the configuration, in a similar manner to the RF module 31 shown in FIG. 11, directions of the magnetic fields H2 and H3 in the pair of output lines 5*a* and 5*b* are always opposite to each other in the signal passband as shown in FIG. 13. Therefore, the electromagnetic waves in the TE mode inside the waveguide 3 can be converted to balanced electromagnetic waves in the TEM mode, and the balanced electromagnetic waves in the TEM mode can be output from the output lines 5*a* and 5*b*. Further, in the configuration, two H plane coupling windows 32 can be formed in arbitrary positions in the wall portion 3*d* (or 3*e*). As a result, the pair of output lines 5*a* and 5*b* can be provided in the arbitrary positions in the wall portion 3*d* (or 3*e*). Therefore, the balanced electromagnetic waves in the TEM mode can be output from the arbitrary positions in the wall portion 3*d* (3*e*).

Although not shown in the diagram, a configuration in which one of the H plane coupling windows 32 and the output line 5*a* as one of the output lines are provided in the region K in FIG. 13 and the other H plane coupling window 32 and the other output line 5*b* are provided in the region M can be also employed. Further, in place of the configuration in which each one of the H plane coupling windows 32 and the output lines 5*a* (and 5*b*) are provided in each of the regions J and L (or the regions K and M) facing each other while sandwiching the center O of the TE mode resonator 2, a configuration in which each one of the H plane coupling windows 32 and the output lines 5*a* (and 5*b*) are provided in each of two regions adjacent to each other (the regions J and K, the regions K and L, the regions L and M, or the regions M and J) can be also employed.

Fourth Embodiment

Figure 14:
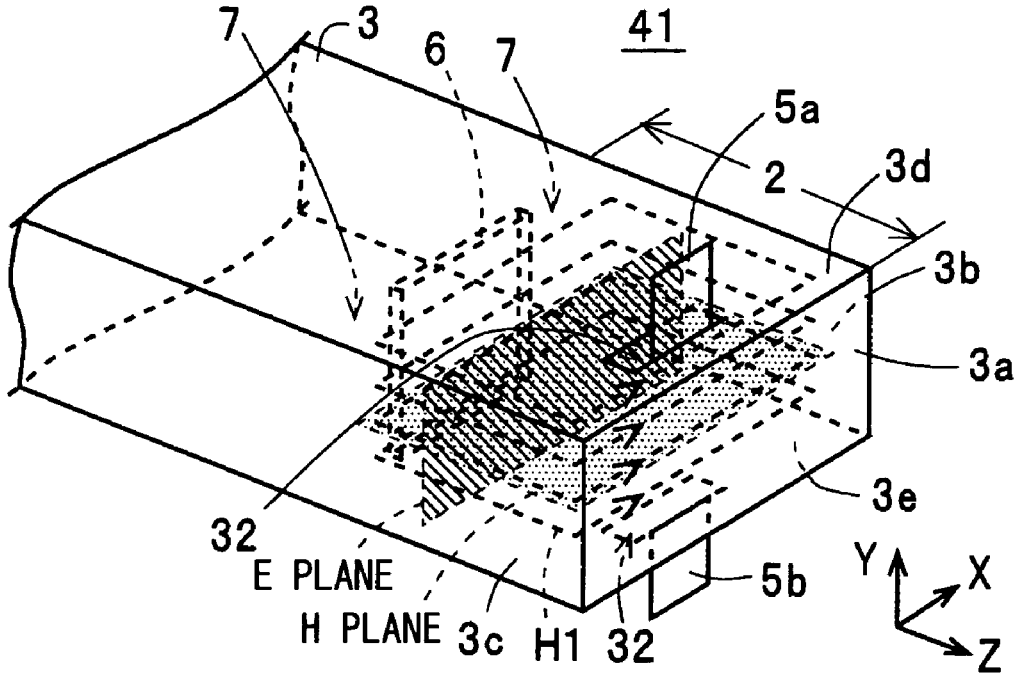
FIG. 14 is a perspective view showing the configuration of an RF module 41 according to a fourth embodiment of the invention.

In the RF module 31A, the H plane coupling windows 32 are formed in one wall portion (the same wall portion) parallel with the H plane in the wall portions forming the TE mode resonator 2 in the waveguide 3. Alternately, an RF module 41 can be also constructed by forming the H plane coupling windows 32 in two wall portions 3*d* and 3*e* parallel with the H plane. In the RF module 41, as an example, as shown in FIG. 14, one of the H plane coupling windows 32 is formed in the region J in the wall portion 3*d* (refer to FIG. 13) and the other H plane coupling window 32 is formed in the wall portion 3*e* so as to face the one H plane coupling window 32. The output line 5*a* as one of the output lines is provided at either the edge on the center side or the edge on the outer periphery side of the TE mode resonator 2 (at the edge on the outer periphery side in FIG. 14 as an example). The other output line 5*b* is provided at the edge of the other H plane coupling window 32, which is the edge on the same side as the edge at which the output line 5*a* is provided in the H plane coupling window 32 as one of the H plane coupling windows (that is, the edge on the outer periphery side). Also in the configuration, in a similar manner to the RF module 31, directions of the magnetic fields in the pair of output lines 5*a* and 5*b* are always opposite to each other in the signal passband of electromagnetic waves. Therefore, electromagnetic waves in the TE mode in the waveguide 3 are converted to balanced electromagnetic waves in the TEM mode, and the balanced electromagnetic waves in the TEM mode can be output from the output lines 5*a* and 5*b*. Further, with the configuration, the two output lines 5*a* and 5*b* can be provided for the wall portions 3*d* and 3*e* facing each other. Therefore, the balanced electromagnetic waves in the TEM mode can be easily output in directions different from each other while sandwiching the waveguide 3.

Fifth Embodiment

Figure 15:
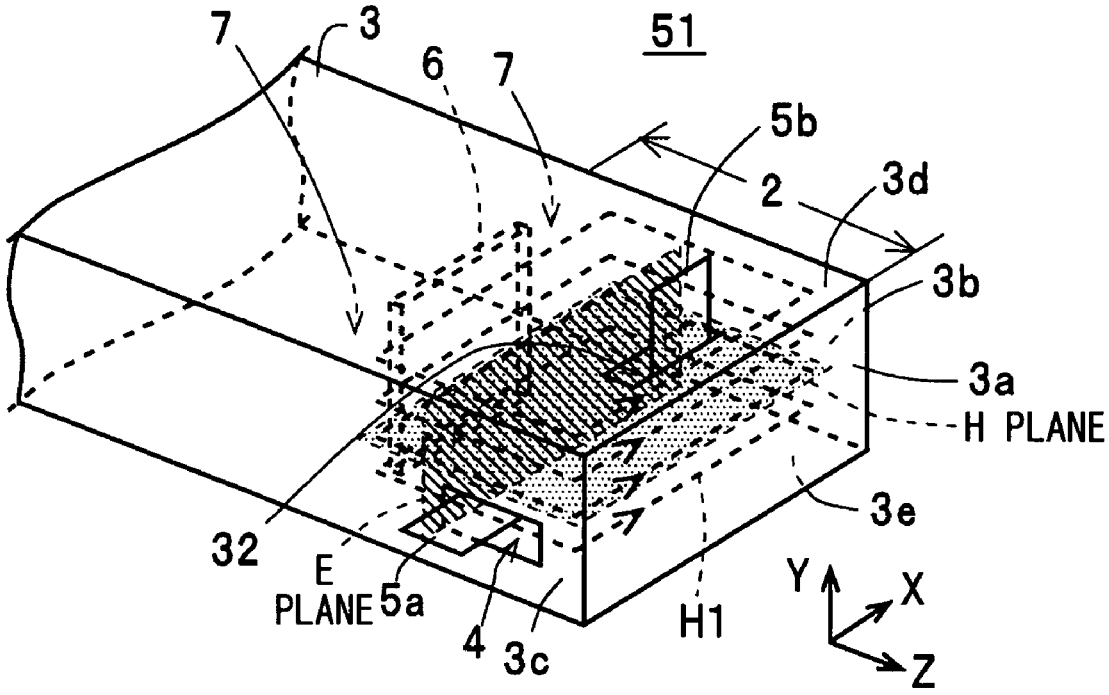
FIG. 15 is a perspective view showing the configuration of an RF module 51 according to a fifth embodiment of the invention.
Figure 16:
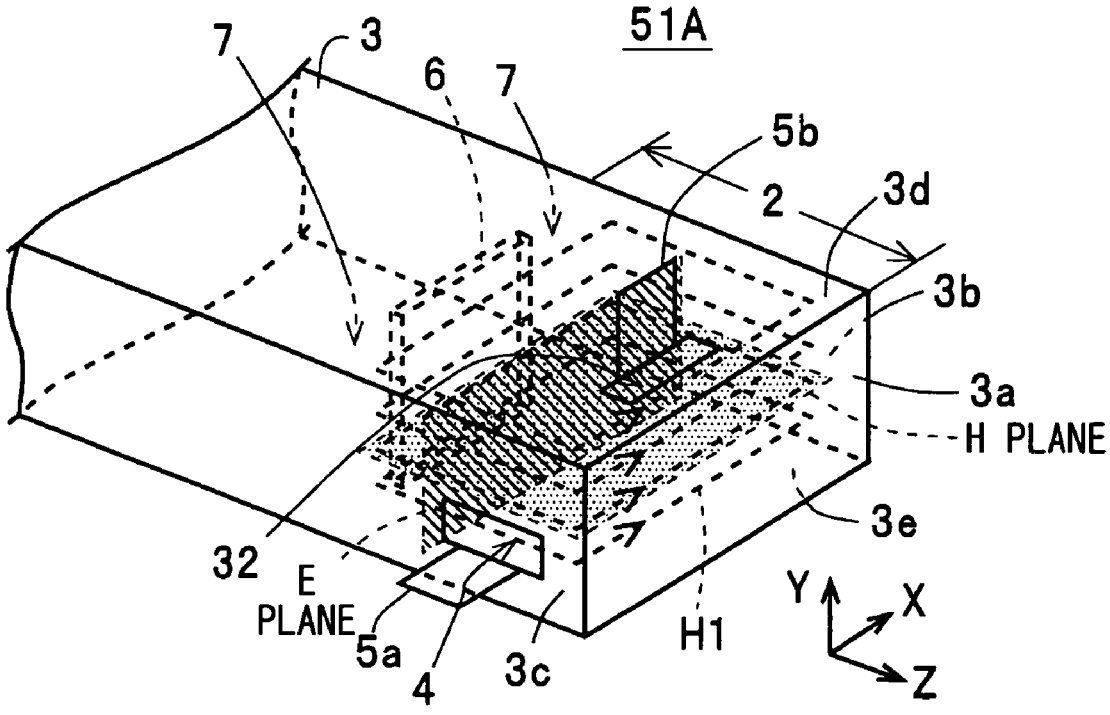
FIG. 16 is a perspective view showing another configuration of an RF module 51A according to the fifth embodiment of the invention.

Although the RF modules 1, 1A, 11, 11A, 21, 31, 31A, and 41 have been described with respect to the example in which any one of the E plane coupling window and the H plane coupling window is provided, a configuration having both of the E plane coupling window and the H plane coupling window can be also employed. In an RF module 51 according to a fifth embodiment, as an example, as shown in FIG. 15, the E plane coupling window 4 is provided in one of the wall portions 3*a*, 3*b*, and 3*c* (in the diagram, the wall portion 3*c* as an example) orthogonal to the H plane, and the H plane coupling window 32 is provided in the region J (refer to FIG. 11) in one of the wall portions parallel with the H plane (the wall portion 3*d* out of the wall portions 3*d* and 3*e* parallel with the H plane as an example in FIG. 15). The output line 5*a* is provided at the edge on the side of the wall portion 3*d* in which the H plane coupling window 32 is formed, in the E plane coupling window 4. The other output line 5*b* is provided at the edge on the outer periphery side (the edge on the wall portion 3*a* side) of the TE mode resonator 2 in the H plane coupling window 32. Since the basic configuration is the same as that of the RF module 1 and the like, the same reference numerals are designated to the same components and the description will not be repeated. Also in the configuration, in a similar manner to the RF modules described above, the directions of the magnetic fields in the pair of output lines 5*a* and 5*b* are always opposite to each other in the signal passband of electromagnetic waves. Therefore, electromagnetic waves in the TE mode in the waveguide 3 are converted into balanced electromagnetic waves in the TEM mode, and the balanced electromagnetic waves in the TEM mode can be output from the output lines 5*a* and 5*b*. Further, with the configuration, by disposing the two output lines 5*a* and 5*b* in the wall portions 3*c* and 3*d* orthogonal to each other, the balanced electromagnetic waves in the TEM mode can be easily output in directions orthogonal to each other. Like an RF module 51A shown in FIG. 16, another configuration in which the output line 5*a* as one of the output lines is provided at the edge on the side of the wall portion 3*e* facing the wall portion 3*d* in which the H plane coupling window 32 is formed in the E plane coupling window 4, and the other output line 5*b* is provided at the edge in the center side of the TE mode resonator 2 in the H plane coupling window 32 can be also employed.

Sixth Embodiment

Figure 17:
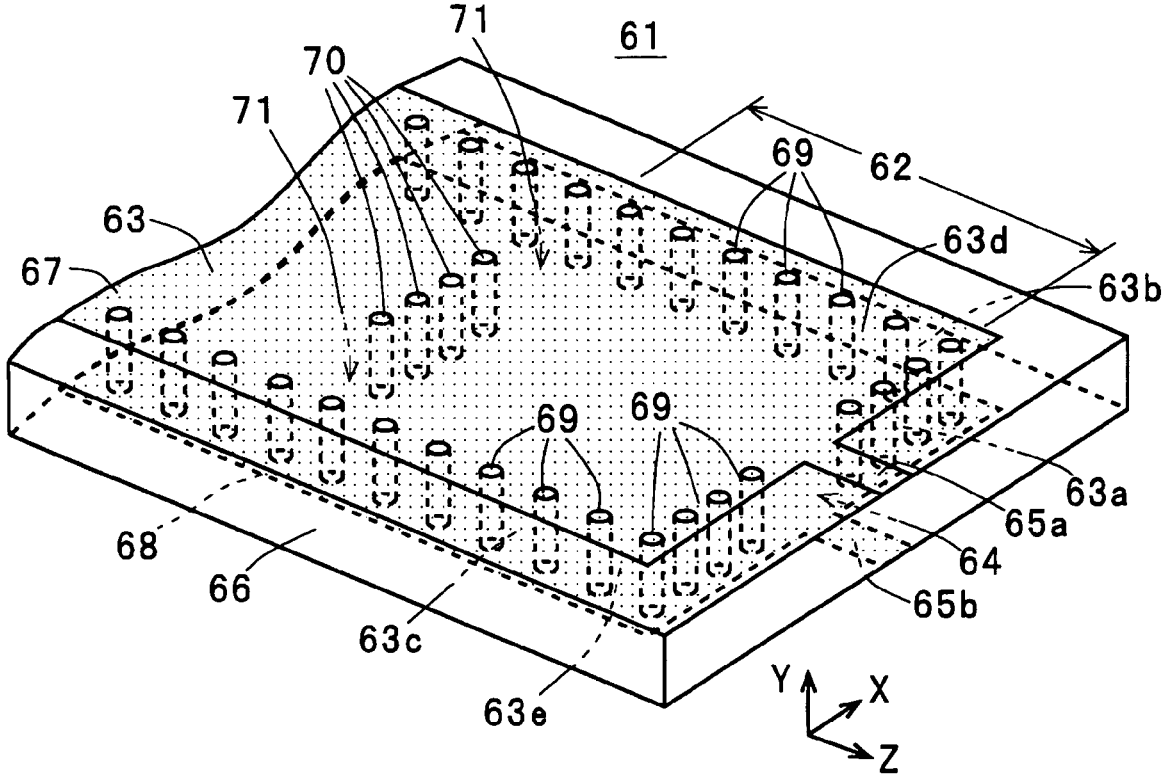
FIG. 17 is a perspective view showing the configuration of an RF module 61 according to a sixth embodiment of the invention.

The invention can be obviously applied to an RF module 61 having a so-called dielectric waveguide shown in FIG. 17. The RF module 61 functions as a filter and includes: a waveguide 63 in which a half-wavelength TE mode resonator 62 resonating at the wavelength which is the half of the waveguide wavelength of the electromagnetic wave in the TE mode (concretely, the $TE_{10}$ mode of the lowest order) is formed; an E plane coupling window 64 formed in a wall portion 63*a* orthogonal to the H plane (parallel with the E plane) out of wall portions 63*a*, 63*b*, 63*c*, 63*d*, and 63*e* forming the TE mode resonator 62 in the waveguide 63; and a pair of output lines 65*a* and 65*b* provided so as to sandwich the E plane coupling window 64 and coupled in the E plane to electromagnetic waves. In this case, the wall portions 63*d* and 63*e* are formed by ground electrodes 67 and 68 provided so as to face each other while sandwiching a dielectric substrate 66. On the other hand, the wall portions 63*a*, 63*b*, and 63*c* are constructed by forming a plurality of through holes 69 as conductors for bringing the pair of ground electrodes 67 and 68 into conduction so as to penetrate the dielectric substrate 66. The inner face of each of the through holes 69 is metallized. The through holes 69 are disposed at intervals of a predetermined width (for example, the width of the quarter of the waveguide signal wavelength) or less except for the portion of the E plane coupling window 64 in order to avoid leakage of electromagnetic waves propagating through the waveguide 63. In FIG. 17, each of the ground electrodes 67 and 68 is hatched while omitting the thickness.

The TE mode resonator 62 is, as an example, formed between a plurality of through holes 70 forming a partition wall provided inside the waveguide 63 and the wall portion 63*a* as a short-circuit plane of the waveguide 63. The TE mode resonator 62 is magnetically coupled to another inner region of the waveguide 63 (a region on the left side of the TE mode resonator 62 in FIG. 17) via coupling windows 71 formed by spaces between the side walls 63*b* and 63*c* of the waveguide 63 and the through holes 70. The E plane coupling window 64 is formed in a center part of the wall portion 63*a* by setting the intervals in the center portion in the plurality of through holes 69 constructing the wall portion 63*a* wide (wider than the quarter of the waveguide signal wavelength). As shown in the diagram, the pair of output lines 65*a* and 65*b* are provided on surfaces on which the ground electrodes 67 and 68 are formed in the dielectric substrate 66 so as to face each other while sandwiching the dielectric substrate 66. One end sides of the output lines 65*a* and 65*b* are directly connected (short-circuit connected) to portions corresponding to the E plane coupling window 64 in the ground electrodes 67 and 68, respectively.

By providing the above-described configuration, the RF module 61 can have a configuration almost the same as that of the RF module 1 while maintaining a small size. As a result, in a similar manner to the RF module 1, electromagnetic waves in the TE mode in the waveguide 63 are converted to balanced electromagnetic waves in the TEM mode, and the balanced electromagnetic waves in the TEM mode can be output from the output lines 65*a* and 65*b*.

Although not shown, also in the RF module 61, by forming the E plane coupling window 64 in the wall portion 63*c* and connecting the output lines 65*a* and 65*b* to parts corresponding to the E plane coupling window 64 in the ground electrodes 67 and 68, the RF module 61 can be constructed like the RF module 11. By forming the E plane coupling windows 64 in the wall portions 63*a* and 63*c*, connecting the output line 65*a* to a portion corresponding to the E plane coupling window 64 in the ground electrode 67, and connecting the output line 65*b* to a portion corresponding to the E plane coupling window 64 in the ground electrode 68, the RF module 61 can be also constructed like the RF module 21. Further, by forming slits in the ground electrodes 67 and 68 to form H plane coupling windows, the RF module 61 can be also constructed like the RF modules 31 or 41.

Figure 18:
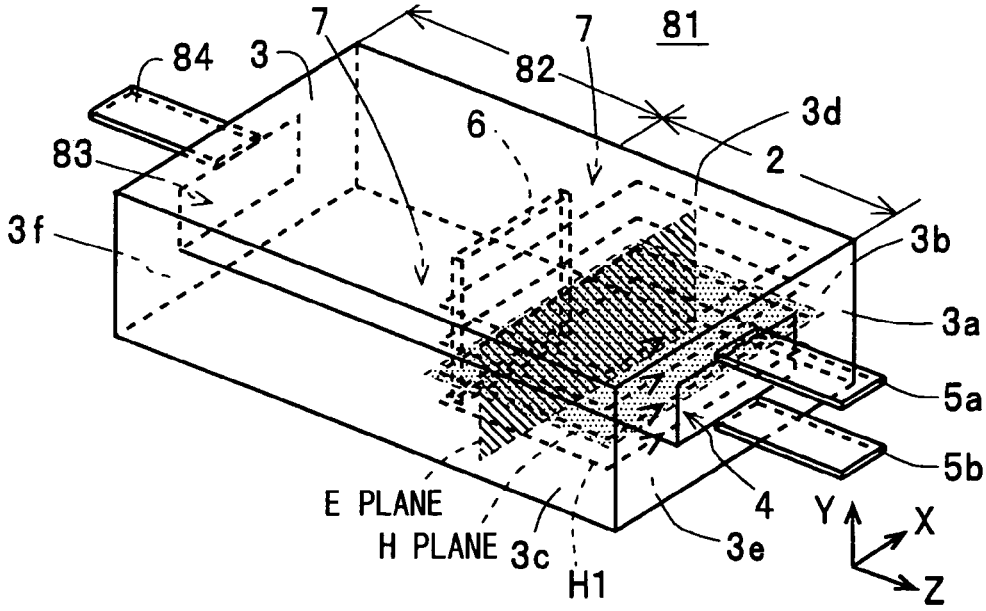
FIG. 18 is a perspective view showing the configuration of an RF module 81 according to another embodiment of the invention.

In the foregoing embodiments, the examples of converting electromagnetic waves in the TE mode to balanced electromagnetic waves in the TEM mode and outputting the balanced electromagnetic waves in the TEM mode (in other words, examples of line converting a waveguide into a plane line) have been described. Alternately, by forming another resonator on the opposite side of the wall portion 3*a* in the waveguide 3 while sandwiching the partition wall 6 and, further, disposing an E plane coupling window (or H plane coupling window) and an input line (a plane line such as a microstrip line, a coplanar line, or a strip line) in any one of wall portions of the waveguide forming the another resonator in the RF module 1, the RF module according to the invention can be applied to an unbalanced to balanced converter (so-called balun) for converting unbalanced electromagnetic waves in the TEM mode to balanced electromagnetic waves in the TEM mode. As an example, an example of constructing a balun on the basis of the RF module 1 is shown in FIG. 18.

The example relates to a structure in which two resonators are connected to each other via a partition wall, so that the structure can also function as a filter having various frequency characteristics. The same reference numerals are designated to the same components as those in the RF module 1 and the description will not be repeated. In an RF module 81 shown in FIG. 18, another resonator 82 is formed between a wall portion 3*f* and the partition wall 6 in the waveguide 3. Further, an E plane coupling window 83 and an input line 84 are provided for (short-circuit connected to) the wall portion 3*f*. Although not shown, in a manner similar to the RF module 81 constructed on the basis of the RF module 1, an RF module can be constructed as a balun on the basis of the RF modules 11, 21, 31, 41, 51, and 61.

Figure 19:
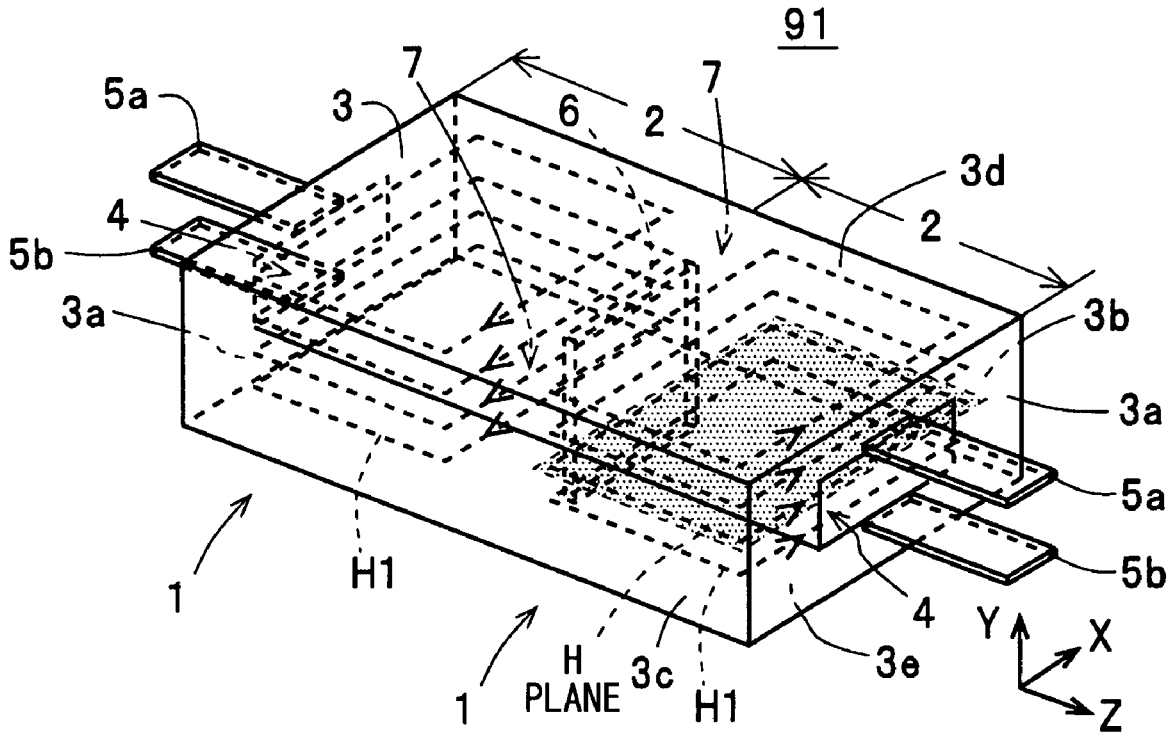
FIG. 19 is a perspective view showing the configuration of an RF module 91 according to a further another embodiment of the invention.

By connecting the RF modules 1, 11, 21, 31, 41, 51, and 61 so as to face each other via coupling windows, an RF module 91 as shown in FIG. 19 can be also constructed. The RF module 91 is constructed by connecting the RF modules 1 to each other via the coupling windows 7 as an example. By using one of two pairs of output lines 5*a* and 5*b* as input lines, the RF module 91 functions as a balanced-input to balanced-output filter. In the diagram, the same reference numerals are designated to the same components as those of the RF module 1. Although the example in which the waveguide has a rectangle shape has been described in each of the foregoing embodiment, the invention is not limited to the example. Obviously, the invention can be also applied to not only a waveguide having a rectangular shape but also a waveguide having a polygonal sectional shape.

As described above, the RF module according to the first aspect includes: a waveguide in which a half-wavelength TE mode resonator is formed; at least one E plane coupling window formed in a wall portion orthogonal to an H plane out of wall portions constructing the TE mode resonator in the waveguide; one output line provided at the edge on the side of one of the wall portions parallel with the H plane in the one E plane coupling window, and magnetically coupled to electromagnetic waves in the TE mode resonator; and another output line provided at the edge on the side of the other wall portion parallel with the H plane in the E plane coupling or another E plane coupling, and magnetically coupled to the electromagnetic waves. With the configuration, the phase difference between electromagnetic waves output from the output lines can be set to almost 180 degrees in the signal passband. Therefore, the electromagnetic waves in the TE mode can be converted to the electromagnetic waves in the TEM mode, and the electromagnetic waves in the TEM mode can be output from the pair of output lines without adjustment. As a result, in the RF module, while realizing a configuration simpler than that in a conventional RF module, an adjusting work can be made unnecessary since it is unnecessary to adjust the capacitance value of capacitive coupling and the inductance value of inductive coupling, and miniaturization can be sufficiently realized since it is unnecessary to provide a signal path which is not allowed to operate as a resonator in addition to the resonator.

In particular, in the case where the RF module according to the first aspect is constructed in such a manner that two E plane coupling windows formed in a single wall portion orthogonal to an H plane out of wall portions constructing the TE mode resonator are provided as the E plane coupling window, the one output line provided at the edge on the side of one of the wall portions parallel with the H plane in one of the two E plane coupling windows, and magnetically coupled to electromagnetic waves in the TE mode resonator, and the another output line is provided at the edge on the side of the other wall portion parallel with the H plane in the other E plane coupling window out of the two coupling windows, and magnetically coupled to the electromagnetic waves, in addition to the above-described effect, two E plane coupling windows can be formed in arbitrary positions in a wall portion. As a result, a pair of output lines can be disposed in arbitrary positions in the wall portion. Therefore, the balanced electromagnetic waves in the TEM mode can be output from the arbitrary positions in the wall portion.

In particular, in the case where the RF module according to the first aspect is constructed in such a manner that a pair of E plane coupling windows formed in a pair of wall portions which are orthogonal to an H plane out of wall portions constructing the TE mode resonator and are different from each other are provided as the E plane coupling window, the one output line is provided at the edge on the side of the one wall portion parallel with the H plane in one of the pair of E plane coupling windows, and magnetically coupled to electromagnetic waves in the TE mode resonator, and the another output line is provided at the edge on the side of the other wall portion in parallel with the H plane in the other E plane coupling window out of the pair of E plane coupling windows, and magnetically coupled to the electromagnetic waves, in addition to the above-described effect, two output lines can be provided for different wall portions. As a result, the balanced electromagnetic waves in the TEM mode obtained by conversion can be output in different directions.

An RF module according to the second aspect of the invention includes: a waveguide in which a half-wavelength TE mode resonator is formed; at least one H plane coupling window formed in a wall portion parallel with an H plane out of wall portions constructing the TE mode resonator in the waveguide; one output line provided at either the edge on the center side or the edge on the outer periphery side of the TE mode resonator in the one H plane coupling window, and magnetically coupled to electromagnetic waves in the TE mode resonator; and another output line provided at either the edge on the center side or the edge on the outer periphery side of the TE mode resonator at the edge of either the one H plane coupling window or another H plane coupling window and magnetically coupled to the electromagnetic waves. With the configuration, the phase difference between electromagnetic waves output from the output lines can be set to almost 180 degrees without adjustment in the signal passband. Therefore, the electromagnetic waves in the TE mode can be converted to the electromagnetic waves in the TEM mode, and the electromagnetic waves in the TEM mode can be output from the pair of output lines in the direction orthogonal to the H plane without adjustment. As a result, in the RF module, while realizing a configuration simpler than that in a conventional RF module, an adjusting work can be made unnecessary since it is unnecessary to adjust the capacitance value of capacitive coupling and the inductance value of inductive coupling, and miniaturization can be sufficiently realized since it is unnecessary to provide a signal path which is not allowed to operate as a resonator in addition to the resonator.

In particular, in the case where the RF module according to the second aspect is constructed in such a manner that two H plane coupling windows formed in one wall portion parallel with an H plane out of wall portions constructing the TE mode resonator are provided as the H plane coupling window, the one output line is provided at the edge on the center side of the TE mode resonator in the H plane coupling window as one of the two H plane coupling windows and magnetically coupled to electromagnetic waves in the TE mode resonator, and the another output line is provided at the edge on the side of the outer periphery of the TE mode resonator at the edge of the other H plane coupling window out of the two H plane coupling windows, and magnetically coupled to the electromagnetic waves, in addition to the above-described effect, two H plane coupling windows can be formed in arbitrary positions in the wall portion. As a result, a pair of output lines can be set in arbitrary positions in the wall portion. Therefore, the balanced electromagnetic waves in the TEM mode can be output from the arbitrary positions in the wall portion.

In particular, in the case where the RF module according to the second aspect is constructed in such a manner that two H plane coupling windows formed in two wall portions parallel with an H plane in wall portions constructing the TE mode resonator are provided as the H plane coupling window, the one output line is provided at either the edge on the center side or the edge on the side of the outer periphery of the TE mode resonator in one of the two of H plane coupling windows, and magnetically coupled to electromagnetic waves in the TE mode resonator, and the another output line is provided at the edge in the other H plane coupling window out of the two H plane coupling windows, which is the edge on the same side as the edge at which the one output line is provided in one of the H plane coupling windows, and magnetically coupled to the electromagnetic waves, in addition to the above-described effect, two output lines can be provided for different wall portions. As a result, the balanced electromagnetic waves in the TEM mode can be easily output in the opposite directions while sandwiching the waveguide.

An RF module according to the third aspect of the invention includes: a waveguide in which a half-wavelength TE mode resonator is formed; an E plane coupling window formed in a wall portion orthogonal to an H plane out of wall portions constructing the TE mode resonator in the waveguide; an H plane coupling window formed in one of wall portions parallel with the H plane in the wall portions; one output line provided at the edge on the side of the wall portion in which the H plane coupling window is formed in the E plane coupling window, and magnetically coupled to electromagnetic waves in the TE mode resonator; and another output line provided at the opening on the side of the outer periphery of the TE mode resonator in the H plane coupling window, and magnetically coupled the electromagnetic waves. With the configuration, in addition to the effects of the RF module according to the second aspect, two output lines can be provided for wall portions orthogonal to each other. As a result, balanced electromagnetic waves in the TEM mode can be easily output in directions orthogonal to each other.

An RF module according to the fourth aspect of the invention includes: a waveguide in which a half-wavelength TE mode resonator is formed; an E plane coupling window formed in a wall portion orthogonal to an H plane out of wall portions constructing the TE mode resonator in the waveguide; an H plane coupling window formed in one of wall portions parallel with the H plane of the wall portions; one output line provided at the edge on the side of a wall portion facing the wall portion in which the H plane coupling window is formed in the E plane coupling window, and magnetically coupled to electromagnetic waves in the TE mode resonator; and another output line provided at the edge on the center side of the TE mode resonator in the H plane coupling window, and magnetically coupled to the electromagnetic waves. With the configuration, in addition to the effects of the RF module according to the second aspect, two output lines can be provided for wall portions orthogonal to each other. As a result, balance electromagnetic waves in the TEM mode can be easily output in directions orthogonal to each other.

In particular, in each of the RF modules according to the first to fourth aspects, in the case where the waveguide is constructed by a pair of ground electrodes provided so as to face each other and a conductor for making the pair of ground electrodes conductive, further miniaturization can be realized.

In particular, in each of the RF modules according to the first to fourth aspects, in the case where an input line capable of supplying electromagnetic waves in the TEM mode as electromagnetic waves in the TE mode to the waveguide, unbalanced electromagnetic waves in the TEM mode can be converted to balanced electromagnetic waves in the TEM mode, and the balanced electromagnetic waves can be output. That is, an unbalanced-to-balanced converter (so-called a balun) for electromagnetic waves can be realized. In this case, by providing each of the RF modules with at least one resonator between the input line and the half-wavelength TE mode resonator, the RF module can function as a filter having various frequency characteristics.

What is claimed is:

1. An RF module comprising:

a waveguide in which a half-wavelength TE mode resonator having wall portions is formed;

one or more E plane coupling windows formed in one or more of the wall portions orthogonal to an H plane;

a first output planar line provided at a first edge of a first E plane coupling window of the one or more E plane coupling windows, the first output planar line being magnetically coupled to electromagnetic waves in the TE mode resonator and outputting electromagnetic waves in TEM mode, the first edge being parallel to the H plane; and a second output planar line being separately formed and electrically isolated from the first output planar line and provided at a second edge of the first E plane coupling window or a second E plane coupling window of the one or more E plane coupling windows that is different from the first E plane coupling window, the second output planar line being magnetically coupled to the electromagnetic waves and outputting electromagnetic waves in TEM mode, the second edge being parallel to the H plane.

2. The RF module according to claim 1, wherein the one or more E plane coupling windows include only the first E plane coupling window, and;

the second output planar line is provided at the second edge of the first E plane coupling window.

3. The RF module according to claim 1, wherein the one or more E plane coupling windows include the first and second E plane coupling windows formed in a single wall portion orthogonal to the H plane, the single wall portion being one of the wall portions, and;

the second output planar line is provided at the second edge of the second E plane coupling window.

4. The RF module according to claim 1, wherein the one or more E plane coupling windows include a pair of E plane coupling windows that has the first and second E plane coupling windows respectively formed in a pair of wall portions of the one or more of the wall portions which are orthogonal to the H plane, and the second output planar line is provided at the second edge of the second E plane coupling window.

5. The RF module according to claim 1, wherein the waveguide comprises a pair of ground electrodes provided so as to face each other and a conductor for making the pair of ground electrodes conductive.

6. The RF module according to claim 1, further comprising an input line capable of supplying electromagnetic waves in the TEM mode as electromagnetic waves in the TE mode to the waveguide.

7. The RE module according to claim 6, further comprising at least one resonator between the input line and the half-wavelength TE mode resonator.

* * * * *